US005714958A

United States Patent [19]

Rudisill

[11] Patent Number: 5,714,958

[45] Date of Patent: Feb. 3, 1998

[54] ANTENNA EXTENDER SYSTEM

[75] Inventor: Charles Albert Rudisill, Apex, N.C.

[73] Assignee: Ericsson Inc., Research Triangle Pk., N.C.

[21] Appl. No.: 651,974

[22] Filed: May 21, 1996

[51] Int. Cl.[6] ..... H01Q 1/24

[52] U.S. Cl. ..... 343/702; 343/900

[58] Field of Search ..... 343/702, 715, 343/877, 900, 901, 903; H01Q 1/10, 1/24, 1/12

[56] References Cited

U.S. PATENT DOCUMENTS

| | | | |
|---|---|---|---|
| 2,496,785 | 2/1950 | Finneburgh et al. | 343/903 |
| 2,522,222 | 9/1950 | Haller | 343/903 |
| 4,520,365 | 5/1985 | Langheck | 343/903 |
| 4,725,845 | 2/1988 | Phillips | 343/702 |
| 4,864,322 | 9/1989 | Yamamoto et al. | 343/903 |
| 5,448,251 | 9/1995 | Gerszberg et al. | 343/903 |
| 5,566,361 | 10/1996 | Nagai | 343/903 |

*Primary Examiner*—Michael C. Wimer
*Attorney, Agent, or Firm*—Jenkens & Gilchrist P.C.

[57] ABSTRACT

A spring-driven pinion gear, rotatably mounted in an enclosure supporting an antenna, automatically extends the antenna upon release of a latch. The pinion gear has a plurality of gear teeth that mate with a gear tooth form provided on an external surface of the antenna. The antenna extender system embodying the present invention, provides a compact and economical system for automatically extending an antenna in portable telecommunication instruments.

7 Claims, 2 Drawing Sheets

ANTENNA EXTENDER SYSTEM

BACKGROUND OF THE INVENTION

1. Technical Field

This invention relates generally to automatic extender systems for antennas, and more particularly to mechanically powered systems, suitable for use in portable telecommunication equipment.

2. Background Art

Retractable antennas are commonly used in global communication equipment such as portable telephones, cellular phones and two-way radios. Typically, retractable antennas used in mobile telecommunication instruments require two-handed operation for extension. For example, when answering a call on a cellular phone, the user must flip open the cover, if so equipped, pull out the antenna with one-hand while holding the phone in the other hand, push a button to answer the call, and then speak. This multiple step operation is cumbersome, particularly if the user is carrying another article or is otherwise impaired from using both hands to extend the antenna.

Electrically powered, motor driven antenna extenders, such as those found on vehicles and larger communication instruments, are undesirable for small mobile telecommunication instruments because of the space requirements for the motor and drive mechanisms, the resultant added weight and cost, and the significant current draw on a limited power source, i.e., the batteries of the instrument.

Other arrangements have been proposed for the automatic extension of antennas for mobile telecommunication instruments. For example, a guided helical compression spring arrangement is disclosed in co-pending application Ser. No. 08/627,448, filed Apr. 4, 1996 by the inventor of the present invention for a RETRACTABLE ANTENNA ASSEMBLY. The guided spring has a substantial length that must be deployed within the antenna enclosure, e.g. the case of a portable phone. Another co-pending application, assigned to the assignee of the present invention, application Ser. No. 08/641,959, filed May 1, 1996 by John C. Phillips for a MECHANICALLY CONTROLLED VELOCITY EXTENDER SYSTEM FOR ANTENNAS, describes an arrangement for controlling the rate at which an antenna is extended. The current tendency to make portable phones smaller and more compact along with added features, places a premium on available space within the instruments to accommodate antenna extender systems.

The present invention is directed to overcoming the problems set forth above. It is desirable to have an antenna extender system for a portable telecommunication instrument that is automatically self extending upon release of a latch or other form of locking mechanism that maintains the antenna in a retracted position when the instrument is not in use. It is also desirable to have an antenna extender system that does not require electrical power for extension of the antenna, is compact and lightweight, and has a simple construction that is inexpensive to manufacture.

SUMMARY OF THE INVENTION

In accordance with one aspect of the present invention, an antenna extender system includes an antenna and an enclosure adapted to support the antenna when extended and protectively enclose the antenna when retracted. The antenna has an external surface upon which a pre-defined gear tooth form is disposed. The antenna extender system further includes a pinion gear that is rotatably mounted in the enclosure and has a plurality of external gear teeth adapted to mate with the gear tooth form on the external surface of the antenna. A means is also provided for rotating the pinion gear in a direction which moves the antenna from a retracted position to an extended position, and a means for selectively maintaining the antenna at the retracted position.

Other features of the antenna extender system embodying the present invention include a stub shaft that extends outwardly from a defined surface of the enclosure, in fixed relationship with the surface. The pinion gear further includes a cylindrical flange extending from the pinion gear toward the defined surface of the enclosure, and has an inner wall surface that is spaced from the stub shaft at a distance sufficient to provide an annular cavity therebetween. A spring is disposed in the annular cavity and has a fixed end attached to the stub shaft and a movable end attached to the inner wall surface of the cylindrical flange of the pinion gear.

DETAILED DESCRIPTION OF A PRESENTLY PREFERRED EXEMPLARY EMBODIMENT

Figure 1:
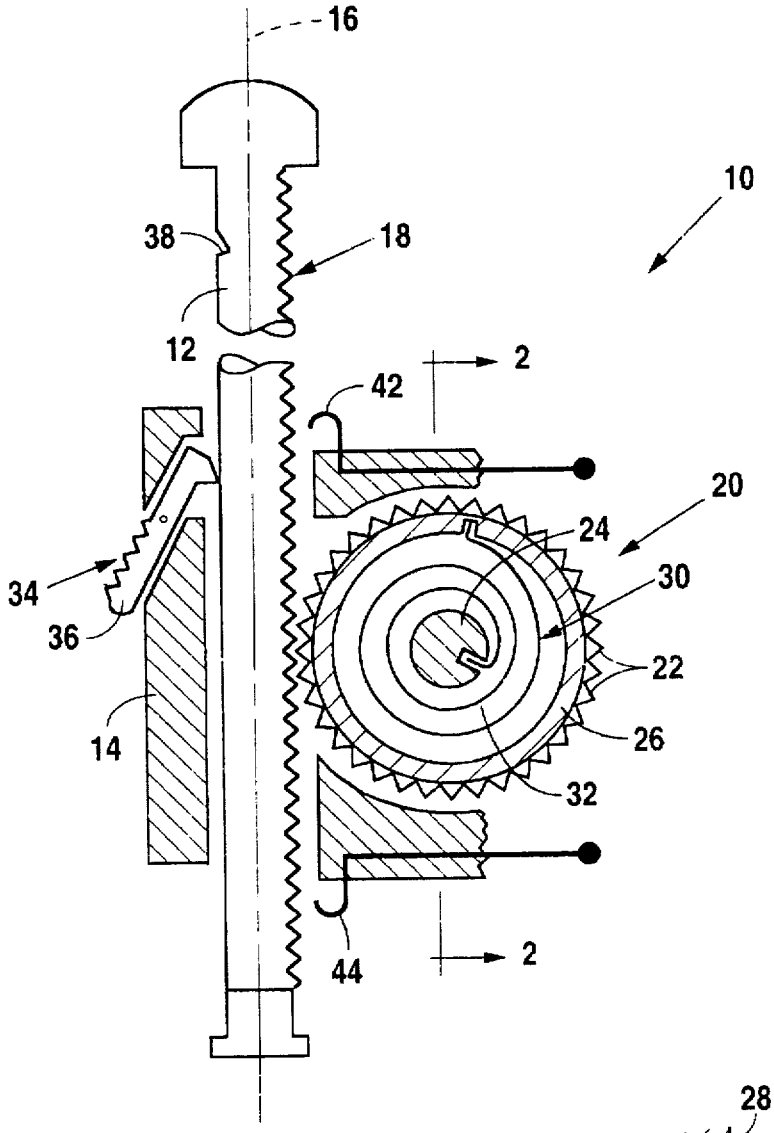
FIG. 1 is a schematic view of the antenna extender system embodying the present invention, showing the antenna in a partially extended position.

An antenna extender system 10, embodying the present invention, has an antenna 12 that is shown in a partially extended position in FIG. 1, and is supported by an enclosure 14 when at the extended position and is protectively enclosed by the enclosure 14 when at a retracted position.

Figure 3:
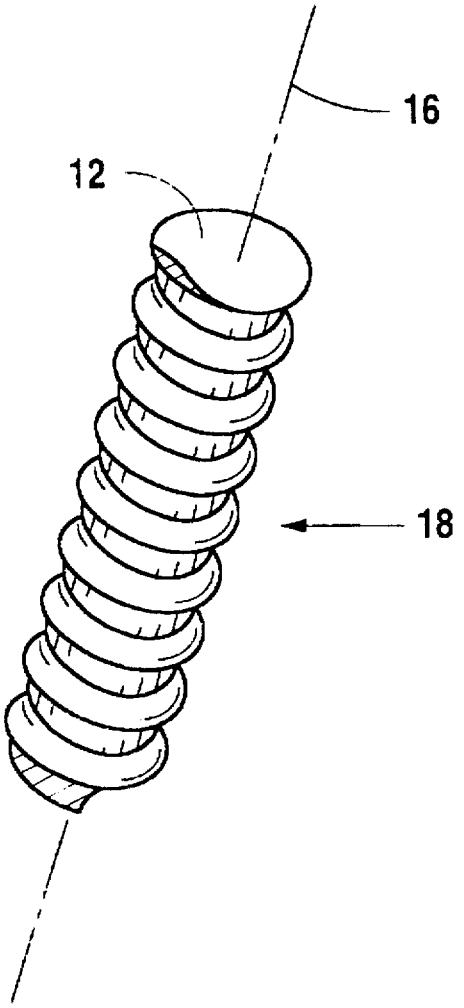
FIG. 3 is a partial three-dimensional view of an antenna, showing one arrangement of a gear tooth form provided on the surface of the antenna in the extender system embodying the present invention.
Figure 4:
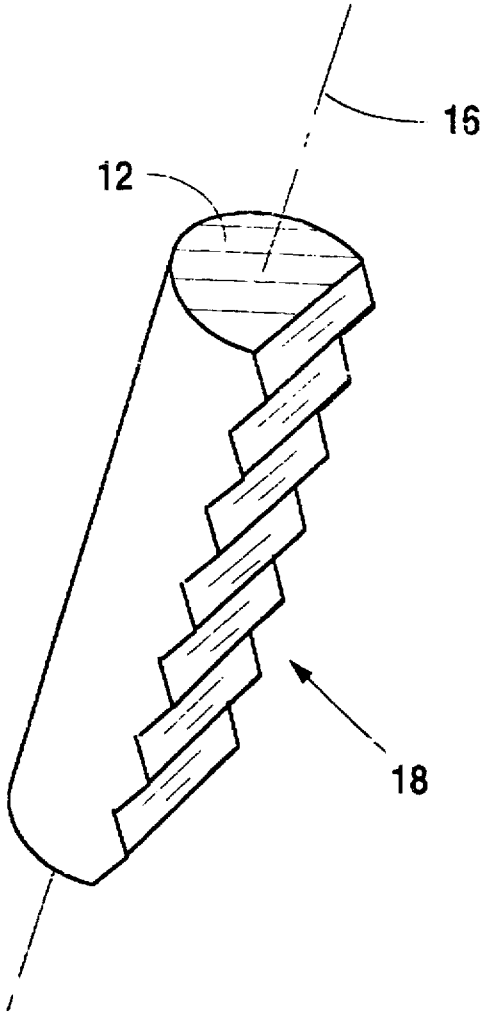
FIG. 4 is a partial three-dimensional view of an antenna showing an alternate gear tooth form on the surface of the antenna in the extender system embodying the present invention.

Importantly the antenna 12 has an external surface concentrically disposed about a longitudinal axis 16. A predefined gear tooth form 18 is disposed on the external surface of the antenna and may, for example, comprise a plurality of rings concentrically disposed about the longitudinal axis 16 of the antenna 12 in axially spaced apart relationship, as shown in FIG. 3, or a gear rack extending in a direction parallel to the longitudinal axis 16, as shown in FIG. 4. The gear tooth form 18 may be generated by machining, molding, or other conventional forming process.

Figure 2:
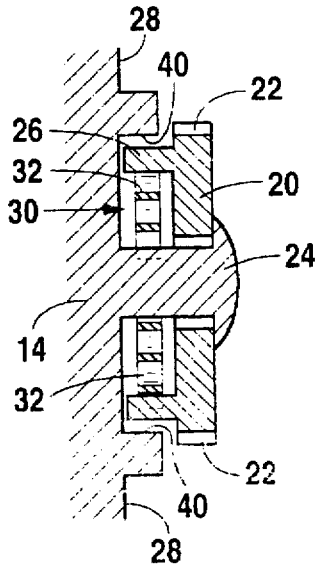
FIG. 2 is a sectional view of a spring biased pinion gear embodying a means for extending the antenna in the system embodying the present invention.

A pinion gear 20 is rotatably mounted in the enclosure 14 and has a plurality of external gear teeth 22 that are shaped to mate with the predetermined gear tooth form 18 on the external surface of the antenna 12. As best shown in FIG. 2, the pinion 20 is rotatably mounted on a stub shaft, or arbor, 24 that is fixedly attached to a defined surface 28 of the enclosure 14. The stub shaft 24 is spaced from the antenna 12 at a distance which provides positive engagement of the external gear teeth 22 of the pinion 20 with the gear tooth form 18 on the external surface of the antenna 12. The pinion 20 also has a cylindrical flange 26 that is concentrically disposed about the axis of rotation of the pinion 20 and extends inwardly toward the defined surface 28 of the enclosure 14.

The antenna extender system 10 also includes a means 30 for rotating the pinion gear 20 in a direction which moves the antenna 12 from the retracted position to the extended position. In the preferred embodiment of the present invention the means 30 for rotating the pinion gear 20 comprises a motor spring 32 that is disposed in an annular cavity defined by the pinon 20, the defined surface 28 of the enclosure 14, an inner wall of the cylindrical flange 28 of the pinon gear 20, and the outer cylindrical surface of the stub shaft 24. One end of the spring 32 is fixedly attached to the stub shaft 24 and the other, moveable, end of the spring 32 is attached to the inner wall of the cylindrical flange 26. Thus, rotation of the pinion gear 20 in a counterclockwise direction, as viewed in FIG. 1, resulting from moving the antenna downwardly to a retracted position, causes the spring to be wound. If not otherwise restrained, the spring 26 will unwind, causing the pinion gear to move in a clockwise direction, as viewed in FIG. 1, and drive the antenna to the extended position. Alternatively, the means 30 for rotating the pinion gear 20 may comprise an arrangement in which the fixed end of the spring 32 is secured to a case rigidly attached to the enclosure 14, and the moveable end of the spring 32 attached to a rotatable shaft operatively connected to the pinion gear 20.

In an illustrative example, the motor spring 32 is formed a flat spring steel strip having a width of about 0.040 inches (1.0 mm), a thickness of 0.006 inches (0.15 mm), and a length of about 10.0 inches (25.4 cm). In this example, the spring 32 has a torque of 0.86 in oz (0.006 Nm) when the spring is at its fully wound position, i.e. the antenna is retracted and 0.6 in oz (0.004 Nm.) when the spring is at its full extension, i.e. the antenna is fully retracted, and is specifically designed for a typical antenna 12 having a mass weight of about 0.011 lb (5 g). Also, in the example, the spring 32 is housed within a case having a diameter of about 0.4 in (1.0 cm) and the pitch line of the gear teeth 22 on the pinion gear 20 has a diameter of about 0.5 in (1.27 cm).

The antenna extender system 10 also includes a means 34 for selectively maintaining the antenna 12 at the retracted position. Preferably the means 34 comprises a spring loaded latch 36 that is slidably mounted in the enclosure 14 and has one end adapted to engage a notch 38 formed in the external surface of the antenna 12. The latch 36 may be a spring biased button or lever, or it may be mechanically interconnected with a flip cover or other moveable element of a portable phone so that when the moveable element is actuated, the latch 36 is automatically moved to its release position. When released the spring driven pinon gear 20 automatically drives the antenna 12 to the extended position. As described above, the spring 32 is then rewound in response to manually retracting the antenna 12.

Desirably, the antenna extension system 10, embodying the present invention, includes an annular wall 40 that extends outwardly from the defined enclosure surface 28. The annular wall 40 is preferably spaced from the outer cylindrical surface of the pinion flange 26 at a distance sufficient to provide for the deposition of a high viscosity material, such as petroleum jelly, white lithium or similar heavy grease, between opposed surfaces to provide resistance to overly rapid rotation of the pinion gear 20 and, consequently, high velocity extension of the antenna 12.

In the exemplary embodiment of the antenna extension system 10, embodying the present invention, electrical interconnection of the antenna 12 with the instrument receiving and transmitting circuitry is provided by an upper contact 42 that, as shown in FIG. 1, is adapted to engage a radial shoulder adjacent the head of the antenna 12 when the antenna 12 is at the retracted position. A lower contact 44 is adapted to engage a radial shoulder adjacent to the lower end of the antenna 12 when the antenna 12 is at the extended position.

Although the present invention is described in terms of a preferred exemplary embodiment, those skilled in the art will recognize that changes in the spring driven pinion 20 and the use of other antenna release latch arrangements may be made, consistent with the specifically stated functional requirements, without departing from the spirit of the invention. Such changes are intended to fall within the scope of the following claims. Other aspects, features and advantages of the present invention can be obtained from a study of this disclosure and the drawings, along with the appended claims.

What is claimed is:

1. An antenna extender system for an instrument having radio signal receiving and transmitting circuitry disposed therein, said antenna extender system comprising:

an antenna having an upper end and a lower end each adapted for electrical interconnection with the radio signal receiving and transmitting circuitry disposed in said instrument, an external surface extending between said upper and lower ends and disposed about a longitudinal axis, and a predefined gear tooth form disposed on at least a portion of said external surface;

an enclosure adapted to support said antenna at an extended position and protectively enclose said antenna at a retracted position;

a pinion gear rotatably mounted in said enclosure and having a plurality of external gear teeth adapted to mate with the predetermined gear tooth form on the external surface of said antenna, said pinion gear being spaced from said antenna at a distance sufficient to provide engagement of the external gear teeth of the pinion gear with the gear tooth form disposed on the external surface of said antenna;

a means for rotating said pinion gear in a direction which moves the antenna from said retracted position to said extended position; and a means for selectively maintaining said antenna at said retracted position.

2. An antenna extender system, as set forth in claim 1, wherein said predefined gear tooth form defined on the external surface of said antenna comprises a plurality of rings concentrically disposed about said longitudinal axis of the antenna and axially spaced apart along said longitudinal axis of said antenna.

3. An antenna extender system, as set forth in claim 1, wherein said predefined gear tooth form disposed on the external surface of the antenna comprises a gear rack extending along said external surface in a direction parallel to said longitudinal axis.

4. An antenna system, as set forth in claim 1, wherein said system includes a stub shaft extending outwardly from a defined surface of said enclosure and fixed therewith, and a cylindrical wall extending outwardly from said defined surface of the enclosure in concentric relationship with said stub shaft and spaced at a predefined distance from said stub shaft, said pinion gear being rotatably mounted on said stub shaft and having a cylindrical flange extending from said pinion gear toward said defined surface of said enclosure and aligned with said cylindrical wall extending outwardly from the defined surface of the enclosure and having an outer wall surface spaced from the cylindrical wall of the enclosure at a distance sufficient to provide a predetermined annular clearance between the outer wall surface of the cylindrical flange of the pinion gear and the cylindrical wall of the enclosure.

5. An antenna extender system, as set forth in claim 1, wherein said system includes a stub shaft extending outwardly from a defined surface of said enclosure and fixed therewith, said pinion gear being rotatably mounted on said stub shaft and having a cylindrical flange extending from said pinion gear toward said defined surface of the enclosure, and said means for rotating said pinion gear comprises a spring operatively connected to said pinion gear.

6. An antenna extender system, as set forth in claim 1, wherein said system includes a stub shaft extending outwardly from a defined surface of said enclosure and fixed therewith, said pinion gear being rotatably mounted on said stub shaft and having a cylindrical flange extending from said pinion gear toward said defined surface of the enclosure and having an inner wall surface spaced from the stub shaft at a distance sufficient to provide an annular cavity therebetween, and said means for rotating said pinion gear comprises a spring disposed in said annular cavity and having a first end attached to said stub shaft and a moveable end attached to the inner wall surface of the cylindrical flange of the pinion gear.

7. An antenna extender system, as set forth in claim 1, wherein said means for selectively maintaining said antenna at said retracted position includes a notch formed in the external surface of the antenna and a latch mounted in said enclosure and moveable between an engaged position at which at least a portion of said latch engages said notch in the antenna and a release position at which said latch is spaced from said notch in the antenna.

* * * * *